United States Patent [19]

Green

[11] Patent Number: 4,699,319

[45] Date of Patent: Oct. 13, 1987

[54] APPARATUS FOR DELIVERING DRINKS ON DEMAND

[76] Inventor: Ethel F. Green, 33 Gold St., New York, N.Y. 10038

[21] Appl. No.: 873,697

[22] Filed: Jun. 12, 1986

[51] Int. Cl.[4] ..... A47G 21/18; B65D 23/00

[52] U.S. Cl. ..... 239/33; 239/24; 215/1 A

[58] Field of Search ..... 239/24, 33; 215/1 A, 215/100 R, 229; D7/42; 229/75; 222/464

[56] References Cited

U.S. PATENT DOCUMENTS

| | | | |
|---|---|---|---|
| 103,299 | 5/1870 | Chapin | 239/33 |
| 455,452 | 7/1891 | Murray | 222/464 |
| 2,052,496 | 8/1936 | Stassi | 215/229 |
| 2,349,054 | 5/1944 | Phipps | 248/106 |
| 2,716,507 | 8/1955 | Graves | 222/464 X |
| 3,773,256 | 11/1973 | Wright | 239/33 X |

*Primary Examiner*—Andres Kashnikow
*Assistant Examiner*—Patrick N. Burkhart
*Attorney, Agent, or Firm*—Charles E. Baxley

[57] ABSTRACT

Apparatus for delivering liquid from a container to the mouth of a patient on demand comprises a flexible tube having first and second ends, the first end being insertable into the container, and a rigid tube having a first end attachable to the second end of the flexible tube and a second end attachable to a flexible drinking straw. The rigid tube has a first portion terminating in the first end of the rigid tube and a second portion extending laterally from the first portion in cantilever fashion so as to locate the second end of the rigid tube laterally spaced from the first portion, whereby the patient, by only a slight head movement, can grasp the straw and obtain liquid from the container through the flexible and rigid tubes and the straw, without assistance from any other person.

5 Claims, 1 Drawing Figure

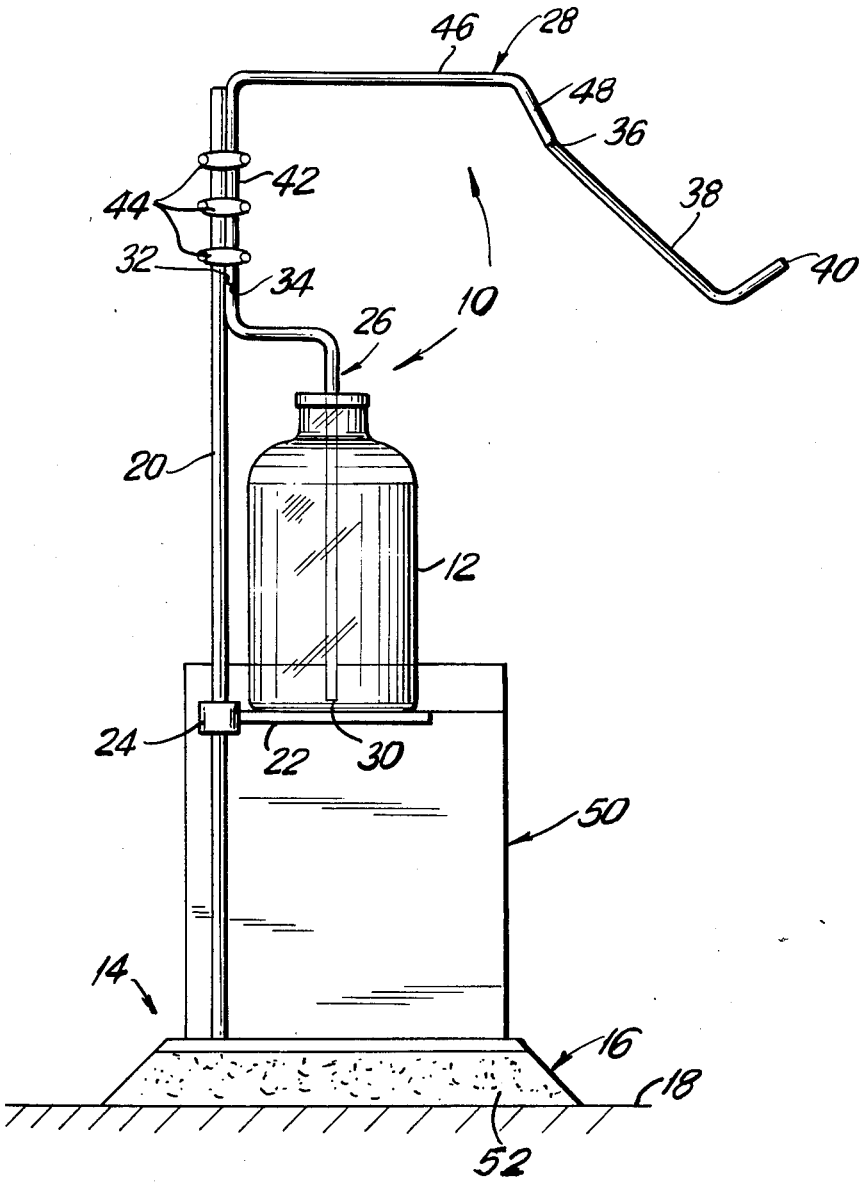
46
28
48
36
38
40
42
44
32
34
26
10
20
12
24
22
30
50
14
16
18
52

APPARATUS FOR DELIVERING DRINKS ON DEMAND

BACKGROUND OF THE INVENTION

This invention relates to apparatus for delivering a drink from a container to the mouth of a patient on demand.

It is well known that hospital and nursing home personnel may be slow, due usually to pressure of other duties, in responding to patients' calls for attention.

It is also well known that many bedridden patients, whether quadriplegic or not, are too handicapped to feed themselves or to reach a tray holding drinks.

Therefore, it is an important object of this invention to provide apparatus for delivering a drink to a bedridden patient whenever the patient so desires, necessitating only a slight head movement on the part of the patient, with no assistance from any other person.

It is another object to provide such apparatus which is of simple, inexpensive construction.

Other objects and advantages will become apparent hereinafter.

The following prior United States patents were found in a search hereon but none is believed to be pertinent to the present invention:

| Patent Number | Issued | Inventor(s) |
|---|---|---|
| Des. 263,254 | March 2, 1982 | Ogle |
| Des. 269,121 | May 24, 1983 | Pollard |
| 2,349,054 | May 16, 1944 | Phipps |
| 2,470,649 | May 17, 1949 | Foo |
| 2,654,556 | October 6, 1953 | Lathrop |
| 3,773,256 | November 20, 1973 | Wright |
| 4,095,812 | June 20, 1978 | Rowe |
| 4,462,544 | July 31, 1984 | Rutzel, et al. |

SUMMARY OF THE INVENTION

The invention provides apparatus for delivering liquid from a container to the mouth of a patient on demand. The apparatus comprises a flexible tube having first and second ends, the first end being insertable into the container. A rigid tube has a first end attachable to the second end of the flexible tube and a second end attachable to a flexible drinking straw. The rigid tube has a first portion terminating in the first end of the rigid tube and a second portion extending laterally from the first portion, in cantilever fashion, so as to locate the second end of the rigid tube laterally spaced from the first portion, whereby the patient, by only a slight head movement, can grasp the straw and obtain liquid from the container through the flexible and rigid tubes and the straw without assistance from any other person.

DESCRIPTION OF THE DRAWING

The single FIGURE shows, somewhat schematically, a vertical elevation of apparatus embodying the invention and related parts.

DESCRIPTION OF THE INVENTION

The drawing shows preferred apparatus, indicated generally at 10, for delivering liquid from a container 12 to the mouth of a patient (not shown) on demand. As shown, container 12 is a bottle.

Apparatus 10 comprises a stand 14 having a base 16 that is shown resting on a floor 18 and a vertical support member 20 projecting upwardly from base a 16. Support member 20 is shown as a rod.

Apparatus 10 further comprises a horizontal platform 22 for supporting container 12. Platform 22 is secured to support member 20, preferably at a vertically adjustable location, by means of a locking collar 24 that is slidable to a desired location on support member 20.

Apparatus 10 also comprises a flexible tube 26 and a rigid tube 28. Flexible tube 26 is of a length that is longer than the height of container 12 and has a first end 30 that is insertable into container 12 and a second end 32 positioned facing upwardly adjacent support member 20.

Rigid tube 28 has a first end 34 and a second end 36. First end 34 of rigid tube 28 is connected to second end 32 of flexible tube 26 in liquid tight relationship therewith, and second end 36 of rigid tube 28 is connected to one end of a flexible drinking straw 38 in liquid tight relationship therewith. Straw 38 has a free end 40 for delivering liquid from container 12 to the patient's mouth on demand of the patient.

Rigid tube 28 has a first portion 42 extending vertically upwardly from first end 34 of rigid tube 28 along support member 20 and secured thereto by securing means shown as adjustable clamps 44.

Rigid tube 28 also has a second portion 46 that is bent at right angles with respect to first portion 42, and extends laterally therefrom in cantilever fashion, and a third portion 48 that extends diagonally downward from second portion 46 to second end 36 of rigid tube 28. More particularly, portion 48 lies in the plane defined by portions 42 and 46 and makes an obtuse angle with portion 46. As shown, the obtuse angle is about 135°. Still more particularly, portions 44 are located on the same side of portion 46.

In result, portions 46 and 48 extend laterally so that end 40 of straw 38 can be placed in close proximity to the patient's mouth, whereby the patient, by only a slight head movement, can grasp end 40 of straw 38 with his or her mouth and obtain liquid from container 12 through tubes 26 and 28 and straw 38, without requiring assistance from any other person.

Apparatus 10 further includes, underneath platform 22, means generally indicated at 50 for maintaining the liquid in container 12 at a desired temperature, either hot or cold.

To avoid scuffing floor 18, base 16 may be provided with a piece of cork 52 or other suitable material, on its underside.

It is apparent that the invention achieves the stated objects and advantages and others.

The disclosed details are exemplary only and are not to be taken as limitations in the invention except as those details may be included in the appended claims.

What is claimed is:

1. Apparatus for delivering liquid from a container to the mouth of a patient on demand, said apparatus comprising a flexible tube having first and second ends, said first end being insertable into the container, and a rigid tube having a first end attachable to said second end of said flexible tube and a second end attachable to a flexible drinking straw, said rigid tube having a first portion terminating in said first end of said rigid tube and a secind portion extending laterally from said first portion in cantilever fashion so as to locate said second end of said rigid tube laterally spaced from said first portion, said rigid tube further including a third portion that extends diagonally downward from said second portion, said third portion terminating in said second end of said rigid tube.

2. Apparatus according to claim 1 wherein said second portion is bent at right angles with respect to said first portion and said third portion lies in the plane defined by said first and second portions.

3. Apparatus according to claim 2 wherein said third portion makes an obtuse angle with said second portion.

4. Apparatus according to claim 3 wherein said obtuse angle is about 135°.

5. Apparatus according to claim 3 wherein said first and third portions are located on the same side of said second portion.

* * * * *